United States Patent [19]

Brummett et al.

[11] 4,143,529

[45] Mar. 13, 1979

[54] TAMPERPROOF SECURITY DOOR LOCK

[76] Inventors: Houston H. Brummett; Norma J. Brummett, both of 5074 Conifer Dr., Bremerton, Wash. 98310

[21] Appl. No.: 795,654

[22] Filed: May 10, 1977

Related U.S. Application Data

[63] Continuation-in-part of Ser. No. 707,814, Jul. 22, 1976, abandoned.

[51] Int. Cl.[2] ..... E05B 55/14

[52] U.S. Cl. ..... 70/152; 292/150; 292/169.18

[58] Field of Search ..... 70/152, 150, 483, 487, 70/416, 418, DIG. 3; 292/169.18, 150, DIG. 24

[56] References Cited

U.S. PATENT DOCUMENTS

| | | | |
|---|---|---|---|
| 528,269 | 10/1894 | Bettys | 292/150 |
| 1,006,816 | 10/1911 | Wolfe | 292/150 |
| 1,059,915 | 4/1913 | Sparks | 292/169.18 |
| 1,081,036 | 12/1913 | Grandits | 292/150 X |
| 1,364,757 | 1/1921 | Herrman | 292/150 |
| 1,520,509 | 12/1924 | Rancour | 292/150 X |
| 1,748,599 | 2/1930 | Dermody | 292/150 |
| 2,002,542 | 5/1935 | McKinney | 292/169.18 X |
| 2,612,771 | 10/1952 | Clark | 70/483 |
| 2,793,520 | 5/1957 | Candia | 70/150 X |
| 2,917,337 | 12/1959 | Schlage | 292/169.18 X |
| 3,425,247 | 2/1969 | Etter | 292/169.18 X |

FOREIGN PATENT DOCUMENTS

| | | | |
|---|---|---|---|
| 7557 | 10/1922 | Netherlands | 70/DIG. 3 |

*Primary Examiner*—Rodney H. Bonck

*Attorney, Agent, or Firm*—Clarence A. O'Brien; Harvey B. Jacobson

[57] ABSTRACT

A mechanism which may be added to existing conventional type cylindrical door locks at the time of manufacture thereof or to such locks already in the field with just a slight modification of the existing lock. The structure of the added security mechanism blocks the throw of the latch bolt and at the same time blocks the retractor to positively prevent opening of the lock by key, turning of the knob, or tampering with the latch. The security device is tamperproof as it is inserted into the interior of the cylindrical lock and can only be disengaged to allow entry from inside the building structure. The lock cannot be opened from the exterior of the door when the security device is engaged, by any conventional method or tampering. The mechanism includes a shaft or rod having an actuating knob on one end thereof which is removable for installation of the device and a guide and alignment pin together with an operating and blocking shaft with projecting wings on a plate member for engagement and disengagement with the latch of the conventional cylindrical lock. A special retaining and bias spring is mounted in appropriate holes in the lock device. A modified cover plate is also required which has a diamond-shaped aperture of sufficient size to receive the rod shaft, guiding pin, and retaining spring member.

9 Claims, 10 Drawing Figures

12
15
19
21
60
61
20
22
23
24
25
26
28
27
71
72
73
75
83
84
85
87
88
89
31
31'
32
34
35
37
38
39
43
45

TAMPERPROOF SECURITY DOOR LOCK

CROSS-REFERENCE TO RELATED APPLICATION

This application is a continuation-in-part of co-pending U.S. application Ser. No. 707,814, filed July 22, 1976, now abandoned.

BACKGROUND OF THE INVENTION

1. Field of the Invention

This invention relates generally to security devices for door locks and in particular to a device which may be added to existing conventional-type cylindrical locks as being manufactured today. The device once added will positively prevent opening of the lock by any means and is completely tamperproof.

2. Description of the Prior Art

A common problem with known type door locks in that they can be tampered with, and entry may be gained by physically opening the lock by forcing the latch open through insertion of latch engaging members such as plastic cards or locksmith tools into the gap between the door and the door frame at the latch engaging point. Another method is to pick the lock itself as a substitute for a key and open the lock in this manner. Also, most security door locks may be opened if a person has a proper key. In many installations, it is very desirable that the lock be made unopenable by any means even by the use of a proper key.

Another problem with known type security door lock mechanisms is that they consist of barrel bolts, chain door fasteners, or other safety devices on the doors in addition to the key operated door lock. All of these types of security devices can be tampered with and defeated by anyone knowledgeable in the art of gaining forced entry.

Another problem with known type burglar resistant locks are that they require special and extensive modification of any existing type lock devices to which they are added or used. The fact that such additional security mechanism cannot be readily added and adapted to many existing type locks is a serious limitation to their acceptance in the field.

Another problem is the necessity for extensive modification of locks in order to install a security device of an extra nature and in the fact that if a defect or failure of some of the components occur, it is difficult and expensive to obtain repair or replacement parts.

Known prior art patents which may be pertinent to this invention are as follows:

U.S. Pat. No. 1,913,859, A. Sperduti, June 13, 1933;

U.S. Pat. No. 1,956,388, L. Kalina, Apr. 24, 1934;

U.S. Pat. No. 2,435,238, W. R. Schlage, Feb. 3, 1948;

U.S. Pat. No. 2,544,959, C. A. Hillgran, Mar. 13, 1951;

U.S. Pat. No. 2,623,279, C. L. Lucius, Dec. 30, 1952;

U.S. Pat. No. 2,942,449, C. White, June 28, 1960.

None of these known prior art devices offers the new and unique features of the invention disclosed herein.

SUMMARY OF THE INVENTION

An object of the present invention is to provide a tamper-proof security door lock mechanism for internal security at time of occupancy of private residences. Once engaged this mechanism will prevent the door from being opened from either the outside or the inside, either with a key or without a key, and will positively prevent retraction of the latch bolt by external force applied thereto. Only upon disengaging the security mechanism of this device may the lock with which it is used be opened.

Another object of the present invention is to provide a security lock mechanism which may be easily added to existing conventional production type cylindrical lock structures. A few large manufacturers make substantially all of the locks in the country today and this device may be added at time of manufacture to these locks with only a slight amount of modification required.

A further object of this invention is to provide an add-on security door lock mechanism which may be installed in the field at the time of installation of a conventional-type cylindrical door lock. Only a slight amount of modification to the conventional door lock is required and this is simple enough that it may be done in the field by a relatively unskilled mechanic if necessary.

A number of features are incorporated in the tamperproof security door lock mechanism of this invention. By a slight modification of conventional-type cylindrical locks at time of manufacture, this additional structure may be easily and quickly added to same. The security device of this invention blocks the throw of the latch bolt and blocks the retractor at the same time, thus preventing opening the lock either by key, turning of the knob on either the outside or the inside of the door, or by tampering directly with the latch mechanism. The security device is completely tamperproof as it is inserted into the interior of the lock and can only be disengaged to allow entry into the building structure from inside of same. The lock cannot be opened from the exterior when the security device is engaged by any conventional means or method of tampering. Even with a key, one cannot gain access through this device. The use of the tamperproof security door lock precludes the requirement for barrel bolts, chain door fasteners, or other safety devices, on the exterior doors of a building or private residence since the tamperproof security door lock cannot be opened when the security device is engaged. This device can be used with any standard spring latch unit or dead latch unit as per the modifications disclosed herein. Most conventional door locks built today can be applied to doors of 1-⅜ inch thickness to 1-¾ inch thickness, either left- or right-hand mount, either inswinging or outswinging and with back set. The device of this invention has application with any of these type installations.

The security door lock mechanism of this invention has been designed for use with existing manufacturers' cylindrical door locks, such as; the Schlage series "A" type locks, the Corbin standard and light duty locks, the Yale series 5300 locks, and the Best 5K and 57K locks. While the device works extremely well with any of the above, it is also usable with other type manufacturers' cylindrical door locks.

The above existing door lock structures only have to be modified a very little at the time of manufacture in order to accept the mechanism of this invention. Also, this device will work with either the standard type latch structure or with the dead latch type structure, with only slight modification required at time of manufacture in the case of the dead latch application.

A lock with the security device installed is the most complete lock available today. With the device disengaged, it performs its normal function. When the security device is engaged, the lock cannot be opened by key, turning of the knob, or by tampering or jimmying the latch as the device will completely block the throw of the cylinder and also blocks the throw of the latch at the same time.

The lock with the security device installed is absolutely tamperproof since it is a permanent part of the lock and cannot be removed from the lock without removing the lock from the door. The operating function is effected on the inside only, with no visible locking parts exposed to the outside. When the device is engaged, entry absolutely cannot be gained without destruction of the lock or forced entry through the door.

An installation of the tamperproof security door lock mechanism of this invention eliminates the need for any other type of security on the door, such as, chain bolts, barrel bolts, dead bolts, or other security devices. It is a "complete" lock providing a normal cylindrical door lock mechanism with tamperproof security.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 10:
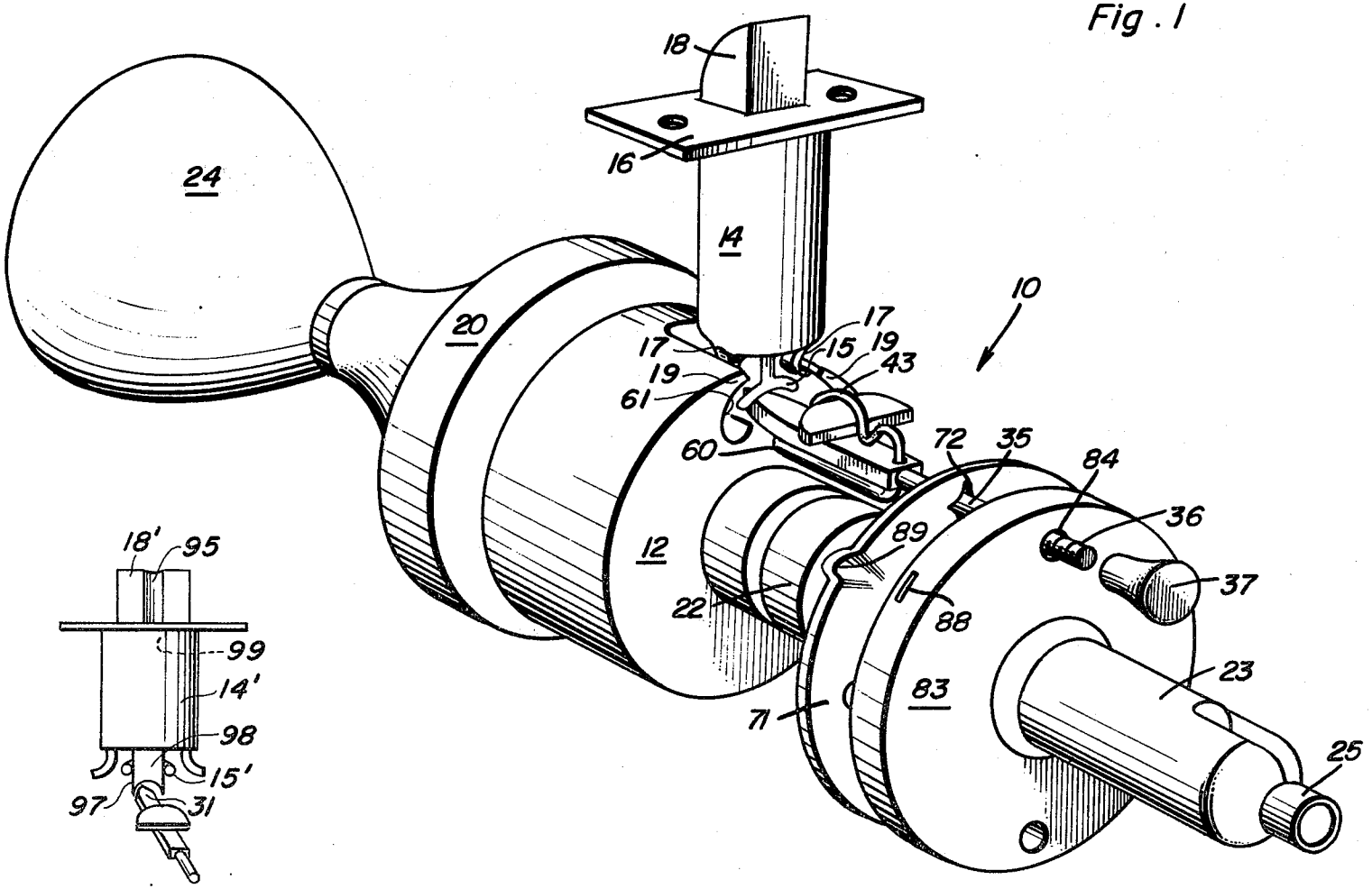
FIG. 1 is a perspective view of the over-all structure as assembled with a conventional key in knob type cylindrical door lock mechanism.
Figures 2, 3, 9:
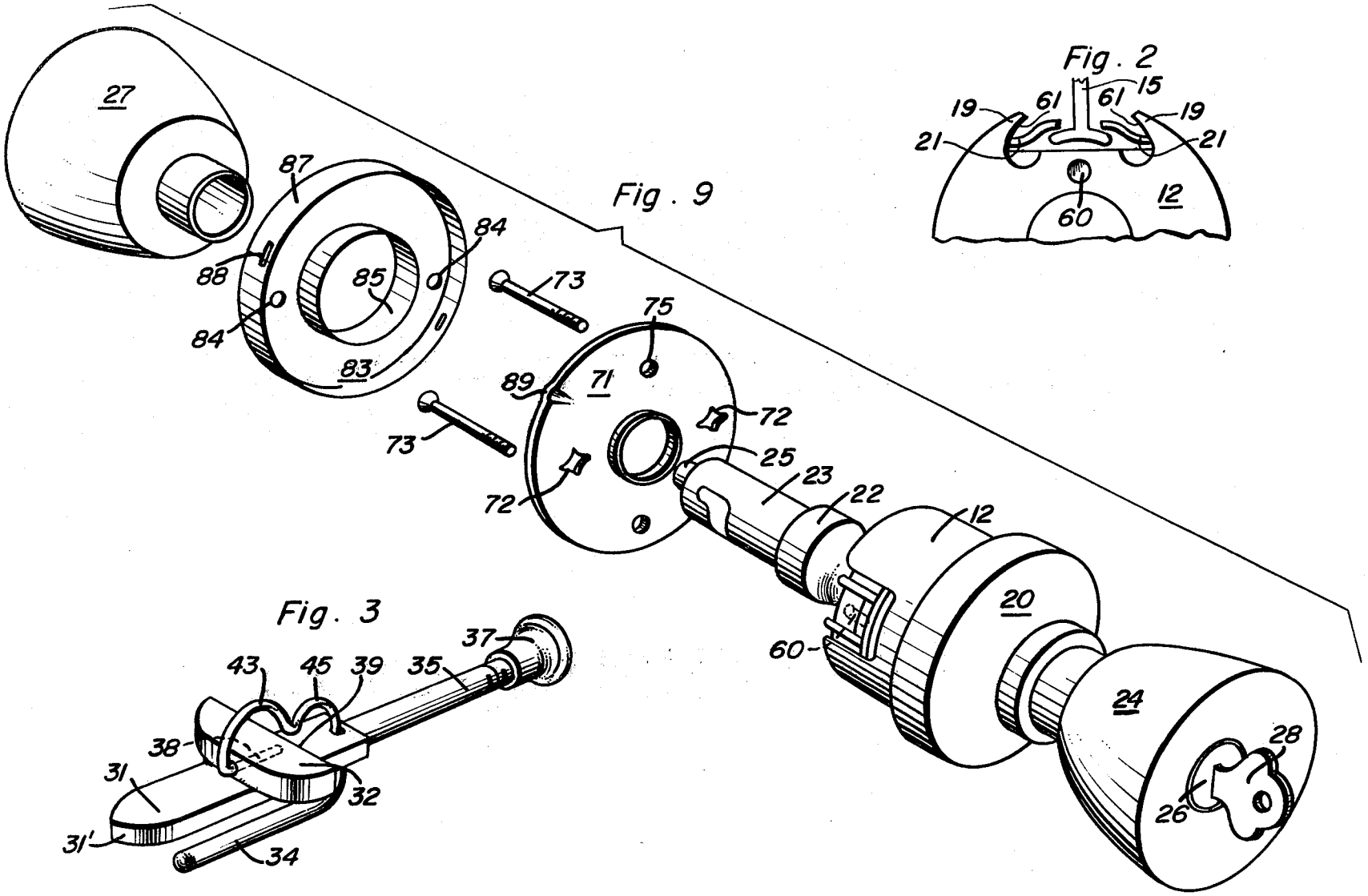
FIG. 2 is an enlarged end view of a modified housing for a cylindrical lock mechanism of conventional type for reception of the security mechanism of this invention.
FIG. 3 is a perspective view of the security device per se of this invention.
FIG. 9 is an exploded perspective view of the components of the device of this invention; and, FIG. 10 is an enlarged idealized perspective view of the structure shown in FIG. 8 in an assembled configuration and in cooperating relation to the security device per se of the invention.

Referring now to FIG. 1 of the drawings, reference numeral 10 indicates in general the tamperproof security device of this invention. The main cylinder housing 12 of a convention-type lock mechanism has associated for operation thereby a latch bolt housing 14. The latch bolt housing 14 has a standard latch bolt plunger 15 disposed therein, lower portions of the plunger 15 being extendible from the lower portion of the housing 14 in a known manner. The other end of the plunger 15 is connected to structure within the housing 14 (not shown) in a known fashion to operate the conventional lock mechanism in a usual fashion. Bolt housing 14 is connected to and slidably held within cylinder housing 12 by projections 17, as shown in FIG. 1, which engage the interior surface 61 of flanges 19 of the cylinder body 12. In this manner, bolt projection 15 is disposed below plunger retractor 21 as seen in FIG. 2. The latch housing 14 is mounted at its upper end to a plate 16 which mounts in the edge of the door with a latch member 18 having a rounded door jamb striker plate engaging face provided on one side thereof, all of the lock structure being conventional. Also associated with the cylinder housing 12 is a door engaging casing 20 integral therewith together with the associated support structure for the rotatable knob 24.

As best seen in FIG. 9, the inside portion of knob 24 is provided with the pin tumbler lock structure 26 per se for reception of an unlocking key 28 therewithin, all of which are well-known and conventional in this type of lock today. Extending from the inner portion of cylinder housing 12 is the operating member 22, 23 and inner knob button 25. The conventional lock of this type is normally assembled through a drilled hole along the edge of the door and an inner casing cover 71 secures the cylinder housing 12 within the door by suitable screws 73, as best seen in FIG. 9. These screws 73 pass through holes 75 provided in the casing cover and in turn screw into the casing 20 in threaded apertures, not shown. Thus, the over-all lock structure will be securely mounted within the holes provided in the door. An outer cover plate 83 having an inner flange portion 85 and an outer flange portion 87 together with detent portions 88 provided therein is then snapped over the attaching plate 71 and retained thereon by the engagement of portions 88 with the preformed crimps 89 on the outer edge thereof. Thus, the cover plate 83 will offer an attractive cover over the attaching structure of the lock and give a finished appearance to the installation. The knob 27 on the inner side of the door is then assembled over the member 23 for operating the lock from inside a room, again as is conventional. With this basic description of a cylindrical type lock, the slight modifications necessary to incorporate the tamperproof security device of this invention will now be described in detail.

Figure 4:
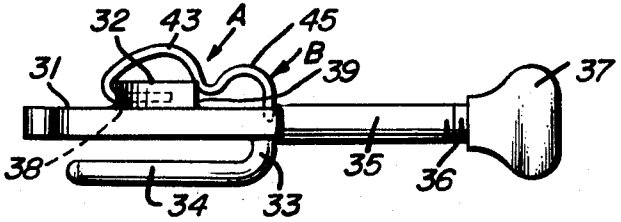
FIG. 4 is a side elevational view of the security device.
Figure 5:
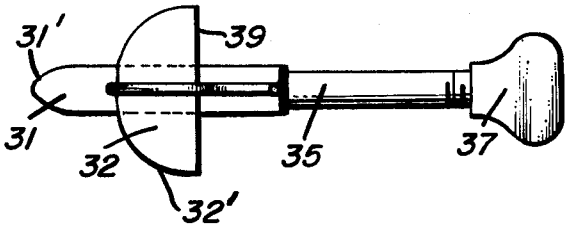
FIG. 5 is a top plan view of the security device.
Figure 6:
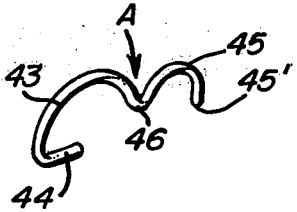
FIG. 6 is a perspective view of the bias and retaining spring per se.

FIGS. 3, 4 and 5 show the structure of the security device in all respects. The device is constructed of hardened steel, zinc plated and dichromated for maximum resistance to corrosion. A shaft or rod 35 is provided at one end with screw threads 36 for reception of an appropriately apertured and tapped knob 37. The outer end has a latch block member 31 provided integrally therewith with a smoothly taperd end 31'. This latch block 31 prevents the throw of the door latch when the device is engaged in the locking position as shown in FIG. 1 and described in greater detail below. Integral with the latch block 31 is a laterally extending winged retractor block 32. This retractor block 32 has a straight edge portion 39 along one side thereof and rounded portions 32' along the opposite edge thereof. This retractor block 32 prevents the unlocking of the lock by a key and also prevents turning of the knob to gain entry whether the door lock is in the lock or unlocked position. This retractor block 32 is also designed to limit the distance of retraction of the security device by means of the edge 39 when the device is moved to the disengaged position. A spring member is also associated with this locking structure, as is a guide rod 34 mounted by an integral portion 33 and extending below the latch blocks 31 and 32, as best seen in FIGS. 3 and 4.

The retractor block 32 acts to prevent movement of the housing 12 (and thus turning of the knob 24) when the present security device is inserted into the "engaged" position, that is, with the latch block 31 disposed into blocking relation to the plunger 15 of the door latch. The rounded portions 32' of the retractor block 32 fit into cutouts 61 conventionally formed in the cylinder housing 12 as best seen in FIGS. 1 and 2. The latch block 31 therefore prevents the throw of the door latch when the present security device is engaged as shown in FIG. 1. Further, the retractor block 32 simultaneously blocks the throw of the cylinder housing 12 by preventing rotation of said housing 12 about its longitudinal axis. The blocking function served by the retractor block 32 thereby prevents turning of the knob 24 and unlocking of the lock even by use of a key.

The security device prevents movement of plunger 15 and plunger retractor 21 by insertion of latch block member 31 and retractor block 32, respectively, beneath these elements. In this manner, with plunger retractor 21 restrained from movement toward the interior of cylinder housing 12 by retractor block 32, doorknobs 27 and 24 are restrained from rotational movement. At the same time, latch block member 31 being disposed beneath plunger 15 restrains radial movement of this plunger within housing 12 thereby eliminating any possibility of opening of the door by tampering with latch member 18.

Figure 7:
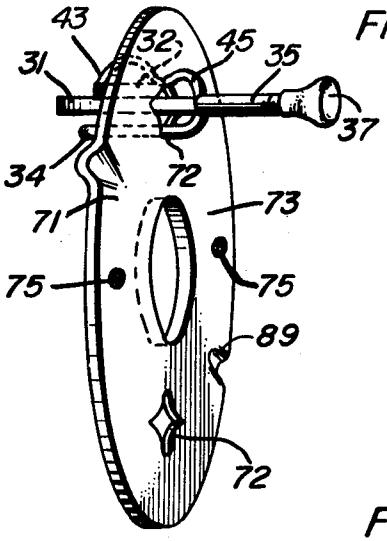
FIG. 7 is a perspective view of the security device and mounting plate as used therewith.

Looking at FIGS. 7 and 9, the mounting of the structure just described may best be seen as arranged with the attachment plate 71 as properly modified. To modify conventional cover plates such as provided with the cylindrical locks with which this device is intended to be used, in addition to the apertures 75 which are provided for the mounting screws 73 as described above, additional diamond-shaped elongated apertures 72 are added. As seen in FIG. 7, one of these apertures receives the security device structure with the shaft 35 passing therethrough after the knob 37 has been removed therefrom. The straight edge portion 39 of the locking block 32 prevents the device from moving any further than said block in an outward direction while the guide rod 34 rides along one of the diamond points and the spring member 43, 45 rides along the other. As can be seen, the valley portions A and B will resiliently and frictionally retain, through the spring bias thereof, the device in one of the two positions, i.e., either in the engaged position, or the disengaged position.

FIG. 2 of the drawings shows the guiding and alignment hole 60 which must be drilled into the lock housing 12. This hole is also indicated in dotted lines in the exploded view of FIG. 9. The hole 60 in the housing 12 functions to guide by means of the guide rod 34 the lateral movement of the security locking mechanism. Thus, the guide hole 60 together with the diamond-shaped aperture 72, when the over-all lock device is assembled with the security device installed, will permit the locking structure to be moved inwardly and outwardly in a properly aligned and guided manner. The double diamond-shaped aperture 72 in the casing member 71 allows for mounting of the device in either a left- or right-hand door lock.

Thus, from the above description, one can see that the only modification necessary to a conventional cylindrical-type door lock of common construction such as the Schlage type is the drilling of the hole 60 in the cylinder housing and the provision of diamond-shaped apertures in the casing cover. These simple modifications can be quickly and readily made during the initial manufacturing of the lock, or may be easily added and made by a locksmith, or even an ordinary home mechanic with explanatory and simple instructions provided with the conversion kit.

Figure 8:
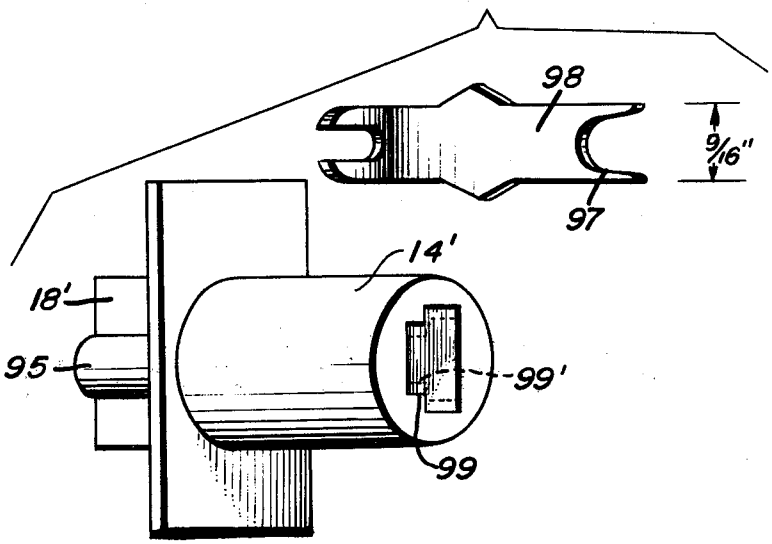
FIG. 8 is a perspective view of a dead latch unit as modified for use with the structure of this invention.

The above description is applicable to latch mechanisms 14–18 of conventional type. However, this device is also applicable to latch mechanisms of the dead latch type. Such a modified dead latch unit is shown in detail in FIGS. 8 and 10 of the drawings. In such dead latch units a plunger structure 95 is also associated with a latch member 18' as is conventional. In the conventional construction of such dead latch units, a dead latch plunger 98 rides in a slot 99 provided in the housing of the dead latch unit. In order for a dead latch unit to work properly with the security mechanism of this invention, the dead latch plunger 98 must be wider than is conventional and the slot 99 also must be wider than is conventional. A widening of the plunger unit to approximately 9/16 of an inch, as shown in FIG. 8 of the drawings, has been found to be entirely satisfactory. A corresponding widened slot 99 is provided which, as shown in the drawings, is enlarged from the conventional size indicated in dotted lines by 99'. A recess portion 97 is provided in the dead latch plunger 98, thereby allowing the plunger 98 to straddle the latch block member 31 of the security device when the over-all structure is assembled, as shown in FIG. 10. The plunger 98, as seen in FIG. 10, is assembled within the slot 99 in housing 14' and surmounts a standard latch bolt plunger 15', the housing 14' and plunger 15' corresponding to the housing 14 and plunger 15 of FIG. 1. Thus, the security device of this invention when engaged will also lock and prevent opening or tampering with the dead latch unit as installed.

The device of this invention may be installed in most existing manufactured cylindrical door locks made today, such as, but not limited to, the ones made by Schlage series "A". Corbin both standard and light duty locks, Yale series 5300 locks, and the Best 5K and 57K locks.

The installation of the security device of this invention into one of the said locks and the installing in a door is relatively easy and simple. The incorporation of this security device is normally accomplished at such time as the lock is actually applied to the door as follows:

(a) the latch unit or modified dead latch unit of FIG. 8 is installed in the door as per factory recommendation normally supplied with the lock mechanism;

(b) the lock unit is installed and engages with the latch again per factory recommendation;

(c) the follower guide 34 is fed into a predrilled hole 60 in the cylindrical housing and shoved forward with the inner edge of the spring 43 resting against the latch unit housing;

(d) the mounting plate 71 is installed, after modification by providing diamond-shaped aperture 72 therein, if not already provided by the factory, with the shaft 35 being fed through the appropriate diamond aperture 72, obviously knob 37 having been removed;

(e) the inside casing member 83 is then applied with the shaft 35 through the appropriate aperture 84 and the casing member snapped into place on the mounting plate 71;

(f) the knob 37 of this security device is then screwed into shaft 35 and with the final installation of the inner door knob 27 the over-all assembly is completed.

By pushing the knob 37 inwardly, the latch blocks 31 and 32 will engage with the internal structure of the latch mechanism and cylindrical lock actuating mechanism to completely block and prevent operation of the lock, door knob, latch, etc. Thus, the door will be locked and blocked and will prevent entry into or exit from the room in any manner even by a person having a key. Only by pulling outwardly on the knob 37 to disengage the tamperproof locking structure will the knob be able to be turned and the door opened.

As can be seen by looking in the various views, the retractor block 32 together with the spring 43, 45 effectively function to retain the device in a resilient, positive manner whether in the locked or unlocked position and together with the guide rod 34 assure the proper operation of the device at all times, with relatively no maintenance and possibility of malfunction.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a locking device having a latch connected to a plunger for displacement therewith and a retractor in operative engagement with said plunger to force movement of said plunger and said latch, and a turning mechanism operatively engaged with said retractor to force movement thereof, the improvement comprising:

a latch locking member having an elongated longitudinal dimension for disposition in an opposing relation to said plunger for blocking movement of said plunger;

a retractor blocking member having an elongated longitudinal dimension connected transversely to said longitudinal dimension of said latch blocking member for blocking movement of said retractor; and handle means disposed exteriorly of the locking device and being operably engaged with said latch blocking member and said retractor blocking member for allowing displacement of said latch blocking member and said retractor blocking member, the handle means being adapted to be grasped and displaced by a user, thereby displacing the latch blocking member and the retractor blocking member relative to the plunger and the retractor.

2. In the combination of claim 1 wherein the improvement further comprises means for retaining the latch blocking member in either opposing or displaced relation to the plunger.

3. In the combination of claim 2 wherein the retaining means comprise a resilient member.

4. In the combination of claim 3 wherein the latch blocking member and the retractor blocking member have apertures formed therein, the aperture in the latch blocking member being disposed outwardly of the retractor member, the aperture in the retractor member being disposed in a forwardmost face thereof, the resilient member further comprising a spring member having first and second ends, the first end of the spring member being received within the aperture in the retractor member and the second end of the spring member being received within the aperture in the latch blocking member.

5. In the combination of claim 4 wherein the spring member has at least two projections disposed between the first and second ends thereof for retaining the latch blocking member in either blocking or unblocking relation to the plunger.

6. In the combination of claim 1 and further comprising an offset bar extending from the latch blocking means for guiding and aligning said latch blocking member.

7. In the combination of claim 6 wherein the locking device has an aperture formed therein for receiving the off-set bar.

8. In the combination of claim 1 wherein the latch blocking member further comprises a rod member connected to the distal end of the latch blocking member, the longitudinal axis of the latch blocking member being substantially parallel to the longitudinal axis of the rod member, the rod member extending exteriorly of the locking device and being connected to the handle means.

9. In the combination of claim 8 further comprising a knob on the second end of the rod member, the knob being removable from the rod member.

* * * * *